US012114758B2

(12) United States Patent
Parker

(10) Patent No.: US 12,114,758 B2
(45) Date of Patent: Oct. 15, 2024

(54) MOUNTABLE ORGANIZER HAVING FRICTIONALLY ENGAGING RECEPTACLES

(71) Applicant: Johana Parker, Pembroke Pines, FL (US)

(72) Inventor: Johana Parker, Pembroke Pines, FL (US)

( * ) Notice: Subject to any disclaimer, the term of this patent is extended or adjusted under 35 U.S.C. 154(b) by 0 days.

(21) Appl. No.: 18/225,035

(22) Filed: Jul. 21, 2023

(65) Prior Publication Data

US 2024/0008624 A1 Jan. 11, 2024

Related U.S. Application Data

(63) Continuation of application No. 16/599,053, filed on Oct. 10, 2019, now abandoned.

(60) Provisional application No. 62/743,655, filed on Oct. 10, 2018.

(51) Int. Cl.

| | |
|---|---|
| ***A45D 44/04*** | (2006.01) |
| ***A45C 11/00*** | (2006.01) |
| ***A45C 13/02*** | (2006.01) |
| ***A47F 5/08*** | (2006.01) |
| ***A47F 7/00*** | (2006.01) |

(52) U.S. Cl.

CPC ..... *A45D 44/04* (2013.01); *A45C 11/008* (2013.01); *A45C 13/02* (2013.01); *A47F 5/08* (2013.01); *A47F 7/0028* (2013.01)

(58) Field of Classification Search

CPC ..... A45D 44/04; A45C 11/008; A45C 13/02; A47F 7/0021; A47F 7/0028; A47F 7/0035; A47F 7/28; A47F 7/283; A47F 5/08; A47B 81/007; B01L 9/06; B25H 3/003; B25H 3/04; B25H 3/06

USPC ..... 132/314; 211/69, 70.6, 75, 69.5, 70.1, 211/85.18, 87.01, 60.1

See application file for complete search history.

(56) References Cited

U.S. PATENT DOCUMENTS 1,092,156 A * 4/1914 Mathis ..... B65D 25/14 206/207
2,774,481 A * 12/1956 Sievers ..... A47G 25/746 211/124
2,899,077 A * 8/1959 Timms ..... B25H 3/04 428/117
2,971,637 A * 2/1961 Simons ..... A61C 3/04 249/85
3,268,087 A * 8/1966 Kramer ..... B25H 3/04 211/119.004
3,367,483 A * 2/1968 Studen ..... B65D 81/1075 217/27
3,487,947 A * 1/1970 Bogar, Jr. ..... A01K 97/08 211/89.01

(Continued)

*Primary Examiner* — Jennifer E. Novosad
(74) *Attorney, Agent, or Firm* — Malloy & Malloy, P.L.; Robert M. Downey

(57) ABSTRACT

An organizer has a planar back panel, a front panel, a core between the back panel and the front panel comprised of a resilient foam material, and at least one receptacle defined by an opening in the front panel aligned with a channel in the core extending from the opening in the front panel toward the back panel. The channel has a smaller cross-sectional area than a cross-sectional area of the opening such that a device having a cross-sectional area larger than the cross-sectional area of the channel will form a friction fit with an interior wall of the channel.

7 Claims, 3 Drawing Sheets

(56) References Cited

U.S. PATENT DOCUMENTS 3,603,551 A * 9/1971 Peterson ..... B25H 3/04 248/314
4,232,784 A * 11/1980 Hesselgren ..... A61C 19/02 206/370
4,265,362 A * 5/1981 Suonvieri ..... B43K 23/002 211/69.1
4,397,395 A * 8/1983 McKelvey ..... A61C 3/04 433/79
4,503,972 A * 3/1985 Nelligan ..... B65D 85/24 273/DIG. 30
4,690,285 A * 9/1987 Stone ..... B43M 99/008 248/442.2
4,826,338 A 5/1989 Kilpatrick
5,005,710 A * 4/1991 Hofer ..... B25H 3/04 D6/567
5,033,625 A 7/1991 Campbell
5,080,230 A * 1/1992 Winnard ..... B25H 3/06 211/DIG. 1
5,188,242 A * 2/1993 Smith ..... B25F 5/029 248/205.3
5,447,243 A * 9/1995 Graber ..... B43M 99/008 211/13.1
5,560,480 A * 10/1996 Singleton ..... B65D 25/101 206/378
5,601,194 A * 2/1997 Brinston ..... H01H 9/025 248/176.1
5,842,566 A * 12/1998 White ..... A47F 7/0021 206/362.4
6,202,862 B1 * 3/2001 Acquaviva ..... B43K 21/003 211/69.5
6,250,467 B1 6/2001 Weder
6,606,880 B1 8/2003 Carlin et al.
6,769,555 B2 * 8/2004 Brady ..... A47G 25/743 211/89.01
6,997,334 B2 * 2/2006 Manix ..... A45F 5/00 211/89.01
D574,665 S 8/2008 James
8,162,156 B1 * 4/2012 Crisman ..... G10D 13/12 211/85.6
8,511,468 B2 * 8/2013 Reeves ..... A61B 50/20 248/176.1
8,770,419 B2 * 7/2014 Carlton ..... B25H 3/04 211/70.6
9,156,531 B2 10/2015 Schweighardt et al.
10,315,551 B2 6/2019 Filipovich et al.
10,363,654 B2 * 7/2019 Young ..... B29C 65/565
10,485,625 B1 * 11/2019 Misle ..... A61B 50/3001
2007/0108145 A1 5/2007 Milardo et al.
2008/0093244 A1 4/2008 Binah et al.
2009/0014349 A1 1/2009 Lee
2011/0174680 A1 * 7/2011 Arvin ..... A45D 33/00 206/581
2013/0328467 A1 * 12/2013 Carlton ..... A47F 5/02 211/70.6
2016/0338460 A1 * 11/2016 Jaffe ..... A45C 11/16
2018/0320834 A1 11/2018 Maguire et al.
2020/0113315 A1 4/2020 Parker
2024/0008624 A1 * 1/2024 Parker ..... A45C 13/02

* cited by examiner

MOUNTABLE ORGANIZER HAVING FRICTIONALLY ENGAGING RECEPTACLES

This non-provisional patent application is a Continuation of non-provisional patent application Ser. No. 16/599,053 filed on Oct. 10, 2019, which is based on provisional patent application Ser. No. 62/743,655 filed on Oct. 10, 2018.

BACKGROUND OF THE INVENTION

Field of the Invention

The present invention relates to organizers for holding an array of articles in an easily accessible and readily removable manner. More particularly, the invention relates to a surface mounted cosmetics organizer having individual receptacles in a resilient foam material that form a friction fit with the separate articles inserted therein.

Description of the Related Art

A hairstylist, cosmetologists, beauticians and ordinary women and men often use many different cosmetic devices, products and applicators when applying makeup. It is not uncommon for persons to have several dozen different cosmetics products and devices. Most women have several different shades and styles of lipstick, not to mention base, blush, eye shadow, mascara along with several brushes, sponges and the like for applying various types of makeup.

As a result, it has become common for both professionals and ordinary people to attempt to organize various cosmetic products in an efficient manner. Existing organizer devices often provide several different compartments of different sizes, shapes and numbers that may be inserted into drawers or purses. Complete portable folding cabinet type devices are also well known. Additionally, many furniture pieces are available that are particularly designed to have many small drawers that are often further subdivided.

The prior art organizing devices suffer from many drawbacks. Cosmetics may be stored in drawers, but this does not particularly organize them. Large folding cabinets may be cumbersome and are prone to being disorganized. With several different storage compartments, it also becomes easy to forget where specific items are located. A person often has to rifle through an entire cabinet drawer or set of drawers to find a particular item. These shortcomings are only exacerbated when used on a more mobile platform. For example, in a mobile home, in an automobile or on a boat, storage devices are subjected to sudden swaying or jerking motions that can knock loose or disorganize the many articles placed in these storage devices.

In addition to the more conventional storage devices that hold various items loosely in compartments or drawers, others have proposed various organizer devices that use a foam core material to help grip the items placed in the organizer device. For example, U.S. Pat. No. 6,769,555 to Brady discloses a clothing accessory hanging apparatus that is structured to be either hanged (e.g., in a clothing closet) or placed on a stand. The apparatus in Brady is particularly intended for organizing, storing, displaying and selectively removing clothing accessories such as men's ties, scarves, belts, gloves, socks and the like. The apparatus includes a front panel, a rear panel and corresponding openings in the front and rear panels that are in alignment. A single layer of a resilient material is sandwiched between the front and back panels. Various slit shapes are formed in the resilient layer, between the correspondingly aligned front and rear openings in the rigid panels, to form narrow channels for receiving the clothing items to fit snugly therein without slipping out. The Brady apparatus is specifically designed and intended to allow the various clothing items to be passed entirely through the front and rear openings so that a portion of the items will stick out from the back, particularly, a long item such as a scarf, belt or tie. This helps to balance the items within the slit opening of the resilient layer with a portion extending on either side of the apparatus so that the items do not simply fall out from the front opening. While the device is particularly suited for clothing, it would not be ideally suited for cosmetic products, such as lipstick, which could potentially be pushed through too far and fall out of the back of the apparatus. Moreover, if multiple small items of cosmetics were placed within the slit openings of Brady, they may fall out from the pressure of pulling back and forth as the user tries to remove a single cosmetic item from the narrow slit openings formed in the resilient material. Moreover, hanging the device or placing it on a stand is not as secure as mounting to a wall surface, thus it would be difficult to remove small cosmetic items, such as lipstick, from the narrow slit openings while trying to maintain the entire apparatus stationary.

U.S. Pat. No. 2,774,481 to Sievers et al. discloses an article supporting rack, which is particularly intended for holding men's ties, as shown in the drawings of this patent. The article supporting rack includes an elongated box shaped structure secured to a backing panel that mounts to a wall. The front of the elongated box shaped structure includes an elongated opening that reveals upper and lower strips of a resilient material. A continuous elongated slit is formed between the upper and lower strips of the resilient material for allowing a folded tie to be tucked between the resilient strips which grip the tie by the inherent characteristics of the resilient material. While the article supporting rack in Sievers may be suited for holding folded men's ties, which are relatively light and easily gripped by the resilient material, the Sievers supporting rack would not be suited for holding an array of various cosmetic devices and products, such as multiple lipstick containers. For example, because Sievers does not provide individual channels or compartments to hold each item, a number of lipstick containers would not fit in each of their own spaces. Instead, they would simply be all bunched together, side-by-side, within the elongated slot formed between the upper and lower strips of resilient material. This may cause the lipstick containers and other cosmetic products to fall out from the article supporting rack, because they are not individually gripped about their entire periphery.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

In view of the foregoing, it is desirable to provide an apparatus or system for organizing cosmetics or other items in a manner that makes them readily accessible, but also prevents them from being easily dislodged and disorganized.

SUMMARY OF THE INVENTION

Disclosed is a cosmetics organizer that securely holds one or more cosmetics devices so that they are easily accessible and readily available. The cosmetics organizer also secures cosmetic devices and receptacles such that they are not easily dislodged.

In one embodiment, a cosmetics organizer has a planar back panel, a front panel, a core between the back panel and the front panel comprised of a resilient foam material, and at least one receptacle defined by an opening in the front panel aligned with a channel in the core extending from the opening in the front panel toward the back panel. The channel has a smaller cross-sectional area than a cross-sectional area of the opening such that a device having a cross-sectional area larger than the cross-sectional area of the channel, but smaller than the opening, will fit through the opening in the front panel and form a friction fit with an interior wall of the channel. The back panel closes off the back of the channel in the foam core, thereby limiting the distance of insertion of the device or article to the thickness of the foam core so that a portion of the device or article remains extended out from the front opening. This allows for ease of grasping of the device or article for removal and replacement within the channel. Thus, the back panel defines a backwall of each channel.

The front panel can be curved or flat (i.e., convex or concave). At least one backwall in a channel may include a mounting hole extending through the back panel.

The cosmetic organizer can be mounted on a wall, on a ceiling or affixed to a portable object. A peripheral wall may extend from the front panel to the back panel around a periphery of the organizer to conceal the foam core that is sandwiched between the front panel and the back panel. At least the front panel of the organizer may be formed in an ornamental shape such as a heart or lips.

It is therefore an object of the present invention to provide a cosmetics organizer that securely holds a plurality of devices so that they are readily accessible but will not become dislodged from their receptacles.

These and other objects and advantages of the present invention will become apparent from a reading of the attached specification and appended claims. There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
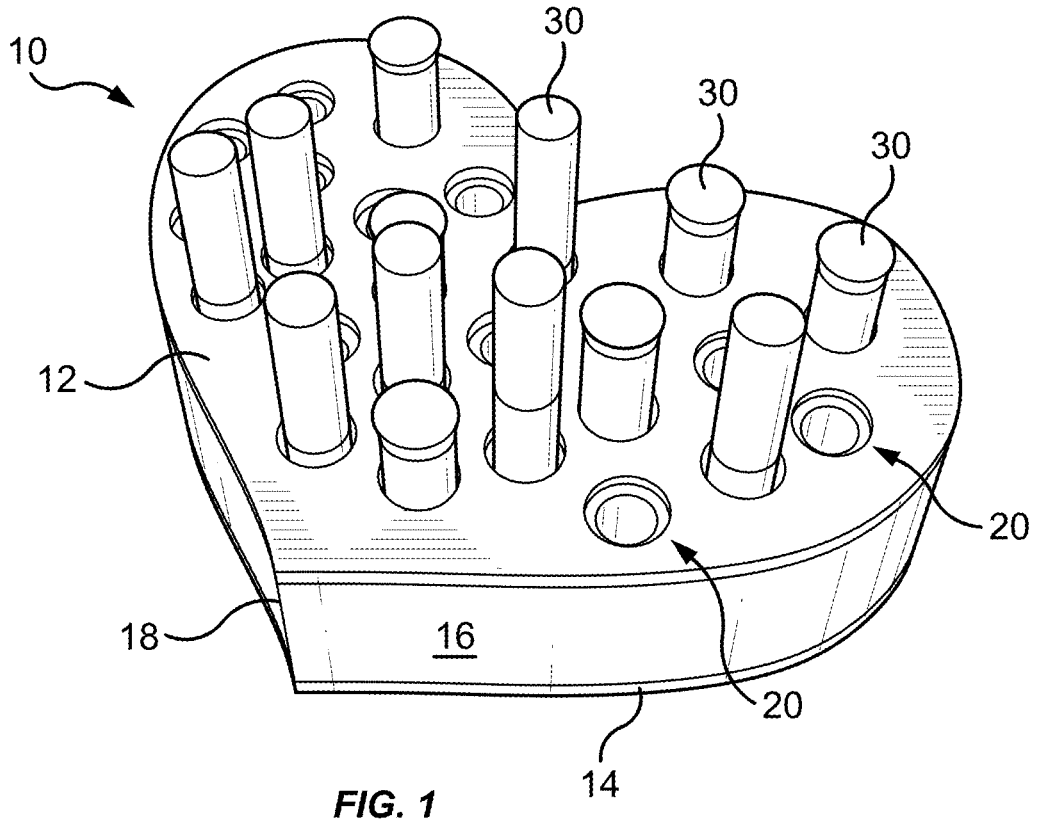
FIG. 1 is a perspective view of a cosmetics organizer in accordance with the principles of the invention.
Figure 2:
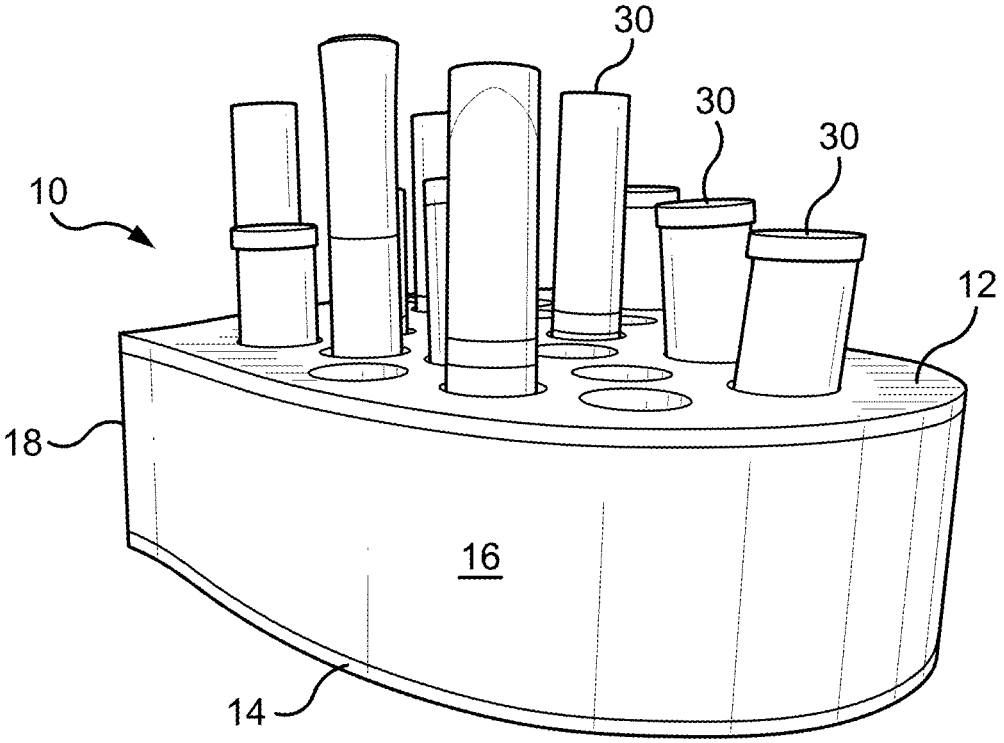
FIG. 2 is another perspective view of a cosmetics organizer in accordance with the principles of the invention.
Figure 3:
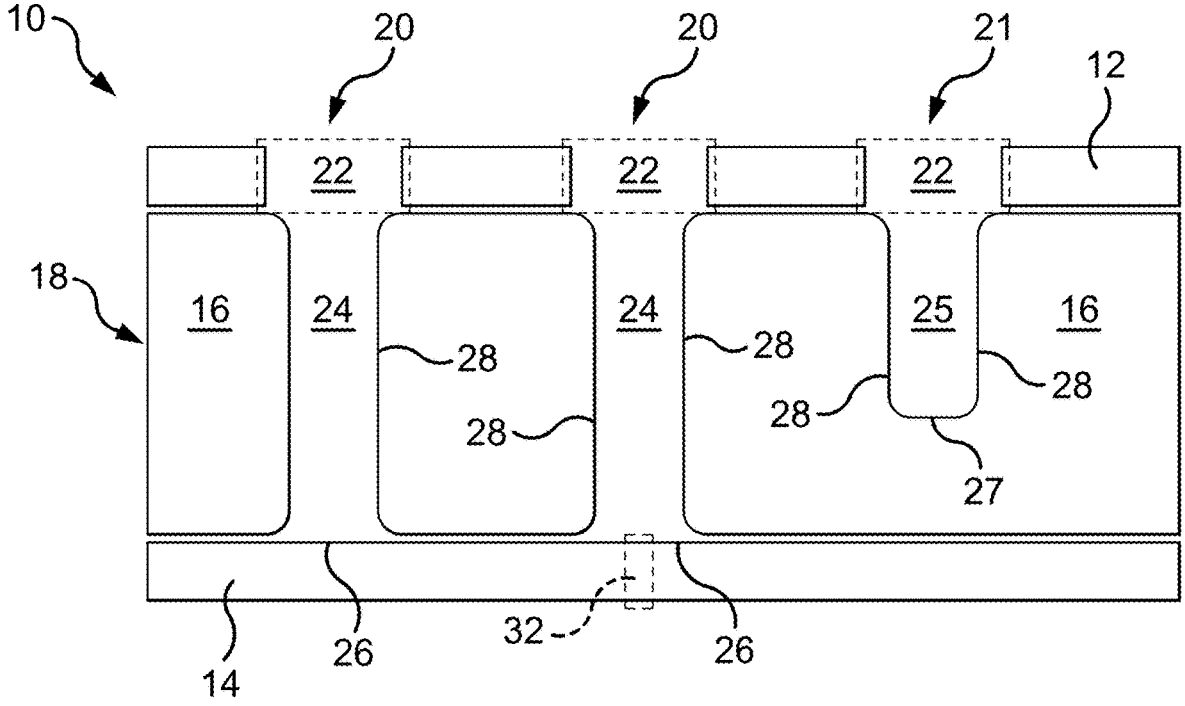
FIG. 3 is a cross-sectional view of a cosmetics organizer in accordance with principles of the invention.

Disclosed is an organizer for storing multiple items that are easily removed by hand but are held firmly enough to prevent the items from falling out. The device includes a foam core sandwiched between a front panel and a back panel. Each of a plurality of receptacles are defined by an opening in the front panel aligned with a channel through the resilient foam core. The channel through the foam core has a smaller diameter or cross-sectional area than its respective opening. When a cosmetic device such as a lipstick is inserted into a receptacle, it forms a friction fit with the sides of the channel through the foam core. The friction fit holds the cosmetic device regardless of how the cosmetics organizer is oriented relative to the direction of gravity. Thus, the cosmetics organizer frictionally engages devices inserted into its receptacles using the interior foam walls of the channels formed through the resilient foam core.

FIGS. 1-5 show a cosmetic organizer 10 in accordance with the principles of the invention. In these figures, the invention is described with reference to a cosmetic organizer 10 that is particularly suited for holding lipstick containers and similar shaped containers and cosmetic devices (e.g., eyeliner pencils). However, it will be apparent to a skilled artisan that the invention may be utilized to organize and retain a vast array of articles beyond cosmetics. For instance, the invention may be used to organize tools, kitchen utensils, office supplies such as pens and highlighters, medicine, electronic devices and the like.

The organizer 10 has a front defined by a front panel 12 and a back defined by a back panel 14. A core 16 is sandwiched between the front panel 12 and the back panel 14. The front panel 12 and back panel 14 are preferably formed from a rigid material such as wood, plastic, metal or the like, and may optionally be laminated, coated or otherwise treated to provide a desired surface appearance and/or texture. The core 16 is formed from a resilient foam material. Other resilient materials would also be suitable. The organizer 10 has a periphery 18 that may optionally be covered by a peripheral wall, not shown. The front panel 12, back panel 14 and core 16 are coextensive such that they are all flush along the periphery 18. In this embodiment, the cosmetic organizer 10 is in the shape of a heart. Those skilled in the art will appreciate that a cosmetic organizer 10 may be formed in any of a variety of shapes.

Figure 4:
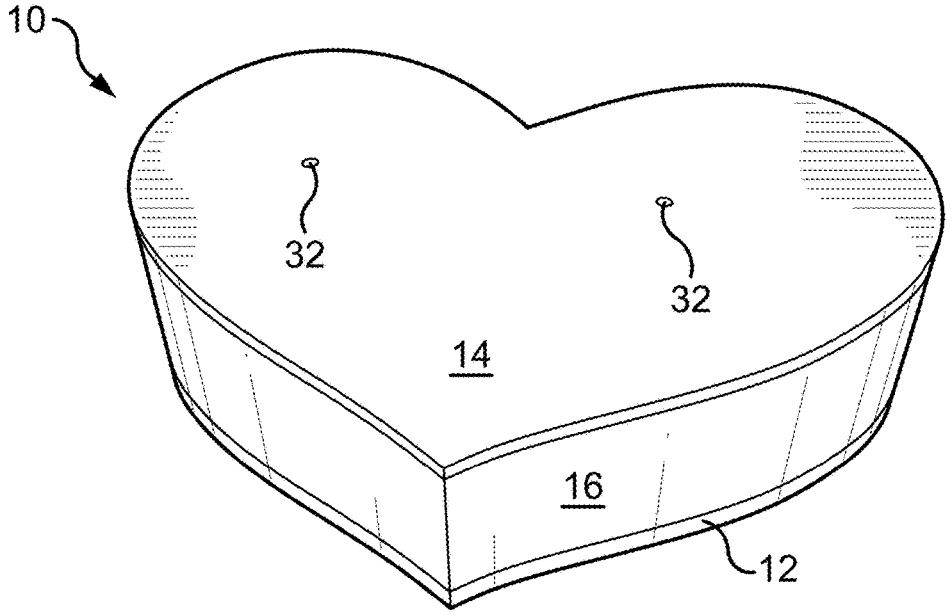
FIG. 4 is a perspective view of a cosmetics organizer in accordance with principles of the invention.

The organizer 10 includes receptacles 20. Best seen in FIG. 3, receptacles 20 are defined by an opening 22 in the front panel 12 and a channel 24 extending through the opening 22, through at least a portion of the core 16 and terminating at a back wall 26 defined by the back panel 14. Optionally, the organizer 10 may also include one or more receptacles 21. Receptacle 21 is defined by an opening 22 in the front panel 12 and a channel 25 extending into the core 16 and terminating at a back wall 27 formed in the material of the core 16 and not extending to the backwall 26. Receptacle 21 has a channel 25 that does not extend entirely through the core 16. Optionally, receptacles in the same organizer may have channels extending different lengths into the core. The organizer 10 may include one or more mounting holes 32 located in the back wall 26 of a receptacle 20 that extends all the way through the core 16. Nails, screws, anchors or other devices may be used to affix the organizer 10 to a wall, ceiling or other surface by using these mounting holes 32. Other mechanisms for mounting an object to a surface are well known in the art. FIG. 4 shows to such mounting holes 32 extending through the back panel 14. Preferably two or more mounting holes 32 are included.

In this embodiment, each opening 22 is circular and each channel 24 is cylindrical. Thus, the receptacles 20 are cylindrical, and some contain lipstick containers 30. The receptacles 20 may optionally have a square, rectangular, oval, trapezoidal, a hexagonal or other cross-sectional shape shapes to accommodate different cosmetic items. For example, eyeshadow is often retained within a rectangular container. Thus, a receptacle having a rectangular cross-section may be more suitable for storing and organizing eyeshadow.

The openings 22 have a larger diameter, and thus larger cross-sectional area, than the channels 24 or 25 through the core 16. The core 16 is formed from a resilient foam material. A lipstick container 30 sized to fit through the opening 22 will compress the interior wall 28 of the channel 24 or 25, forming a friction fit that holds the lipstick tube securely in place. The static friction force between the interior wall 28 and a device inserted into the receptacle 20 or 21 is greater than the force of gravity but is still low enough to allow a person to easily withdraw the device from the receptacle 20.

Figure 5:
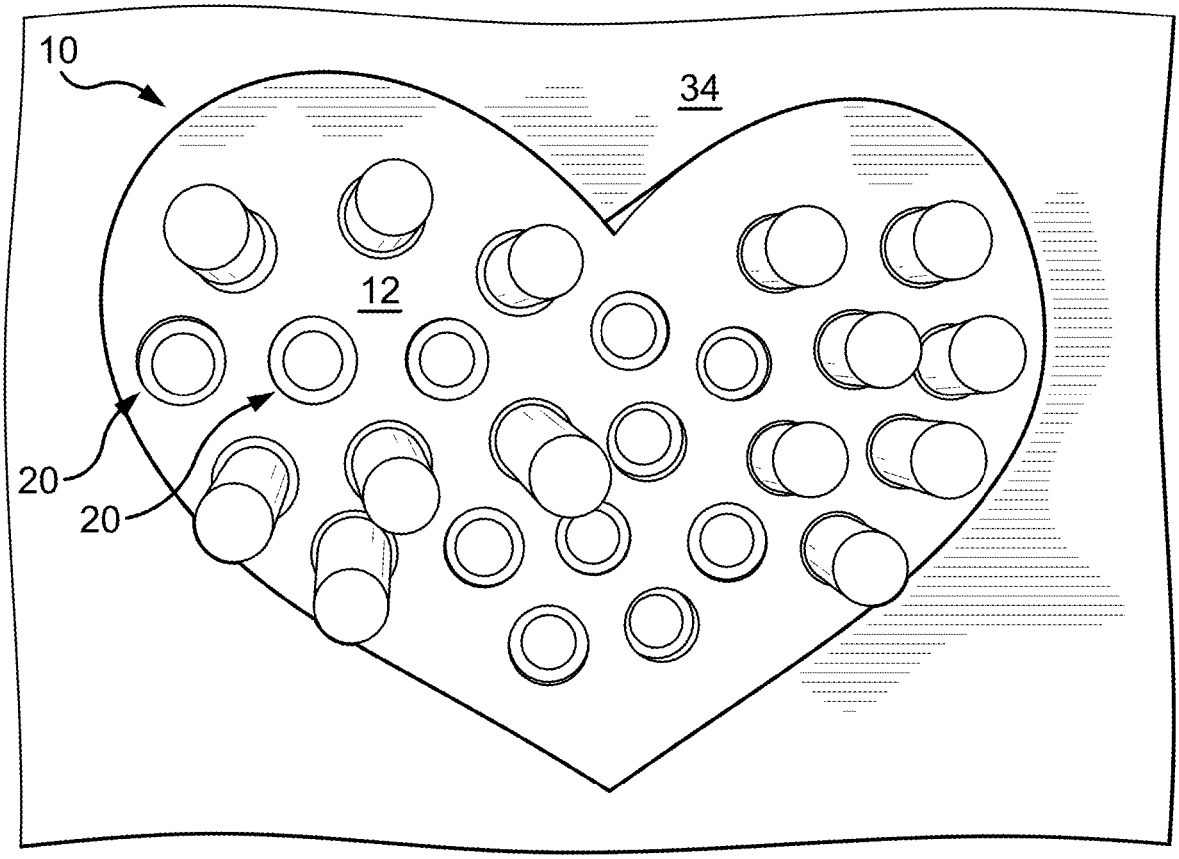
FIG. 5 is a perspective view of a cosmetics organizer affixed to a wall in accordance with the principles of the invention.

The organizer 10 may be mounted on a wall 34 as shown in FIG. 5. Optionally, the organizer may be mounted upside down on a ceiling or similar surface. The organizer 10 is also particularly suitable for use in buildings where earthquakes are common, on boats, in mobile homes, on airplanes or in other environments subjected to disruptive forces. Because of the devices relatively simple design, it may be produced quickly and efficiently. The front panel 12, back panel 14 and core 16 may all be cut from their respective materials and sandwiched together using a simple adhesive. The openings 22 and channels 24 may be cuts before or after the front panel 12 and core 16 have been attached to each other. In addition, it is relatively easy, inexpensive and efficient to form an organizer in accordance with the principles of the invention in a variety of shapes. The cosmetic organizer 10 of the present invention as shown in the Figures has a heart shape. However, any other desired shape may readily be formed from the same materials.

The organizer 10 of the present invention includes a planar, flat front panel 12 and a core 16 having a uniform thickness. While it is generally desirable to have a back panel 14 that is flat and planar, the front panel may be curved and the core 16 may be shaped to accommodate a curved front panel such that the organizer 10 has a distance between the front panel 12 and the back panel 14 that varies. Optionally, channels may be formed in the core that extend inward from the periphery instead of from the openings in the front panel. This allows devices to be secured by a friction fit along the periphery of the device instead of only on the front. If a peripheral wall is included, wrapped around the periphery, openings aligned with the peripheral channels may be provided also.

The embodiment shown in FIGS. 1-5 utilizes a core material comprising a foam. Foams suitable for use in accordance with the principles of the invention for providing a friction fit with items stored include but are not limited to ethylene-vinyl acetate (EVA) foam, also referred to as polyethylene-vinyl acetate (PEVA), low-density polyethylene (LDPE), expanded polypropylene (EPP), expanded polystyrene (EPS), and polyurethane (PU) foam.

In addition, it may be desirable to utilize integral skin foams. Integral skin foams, also known as self-skin foam, is a type of foam with a high-density skin and a low-density core. It can be formed in an open-mold process or a closed-mold process. In the open-mold process, two reactive components are mixed and poured into an open mold. The mold is then closed and the mixture is allowed to expand and cure. Examples of items produced using this process include arm rests, baby seats, shoe soles, and mattresses. The closed-mold process, more commonly known as reaction injection molding (RIM), injects the mixed components into a closed mold under high pressures. Foams may be formed such that the integral skin forms along the inside walls of the organizer's receptacles. This may prevent dirt and particulates from accumulating within the receptacles and damaging, disfiguring or otherwise rendering undesirable the inside walls of the receptacles. Other materials besides foam may be utilized. Any material suitable for forming a friction fit with items placed within the receptacles may be used.

Since many modifications, variations and changes in detail can be made to the described embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A cosmetics organizer comprising:

a rigid back panel;

a rigid front panel;

a foam material core sandwiched between the rigid back panel and the rigid front panel;

a plurality of receptacles defined by openings in the rigid front panel;

a plurality of channels in the foam material core, and each of the plurality of channels aligned with a corresponding one of the openings in the rigid front panel and extending from the opening in the rigid front panel toward the rigid back panel, and at least one of the channels extending from the opening in the rigid front panel to the rigid back panel and terminating at the rigid back panel;

each of the plurality of channels having a smaller cross-sectional area than the cross-sectional area of the corresponding aligned opening in the rigid front panel, wherein a cosmetics article having a cross-sectional area smaller than the opening in the rigid front panel and a cross-sectional area larger than the cross-sectional area of the aligned channel is configured to form a friction fit with the foam material core surrounding the channel; and at least one mounting hole formed through the rigid back panel and accessible through one of the plurality of channels and aligned opening in the rigid front panel to allow passage of a fastening device therethrough to mount the cosmetic organizer to a surface.

2. The cosmetics organizer as recited in claim 1 wherein the rigid front panel is flat.

3. The cosmetics organizer as recited in claim 1 wherein the rigid front panel is convex.

4. The cosmetics organizer as recited in claim 1 wherein the rigid front panel is concave.

5. The cosmetics organizer as recited in claim 1 wherein the rigid back panel is flat.

6. The cosmetics organizer as recited in claim 1 wherein the foam material core is a resilient foam material.

7. The cosmetics organizer as recited in claim 1 wherein at least one of the plurality of channels extends from the corresponding aligned one of the openings in the rigid front panel and terminates before the rigid back panel.

* * * * *